US006038823A

United States Patent [19]

Gallimore et al.

[11] Patent Number: 6,038,823

[45] Date of Patent: Mar. 21, 2000

[54] ADJUSTABLE PIER RAILROAD HOUSE ASSEMBLY HAVING DUAL ADJUSTMENT CAPABILITIES

[75] Inventors: Michael B. Gallimore, Douglasville; Donald Gibson, Newnan, both of Ga.

[73] Assignee: Serrmi Products, Inc., Atlanta, Ga.

[21] Appl. No.: 09/019,370

[22] Filed: Feb. 5, 1998

Related U.S. Application Data

[60] Provisional application No. 60/070,631, Jan. 7, 1998.

[51] Int. Cl.[7] ..... E02D 27/32

[52] U.S. Cl. ..... 52/126.1; 52/169.9; 52/741.15; 52/745.12

[58] Field of Search ..... 52/169.9, 64, 126.1, 52/126.3, 126.5, 741.15, 745.12; 405/221, 196, 199

[56] References Cited

U.S. PATENT DOCUMENTS

| | | | |
|---|---|---|---|
| 2,944,403 | 7/1960 | Smith | 405/199 |
| 2,995,900 | 8/1961 | Hunsucker | 52/169.9 |
| 3,634,985 | 1/1972 | Tipton | 52/126.1 |
| 3,750,349 | 8/1973 | Deike . | |
| 3,771,273 | 11/1973 | Brodie | 52/169.9 |
| 4,634,319 | 1/1987 | May . | |
| 4,899,497 | 2/1990 | Madl, Jr. . | |
| 4,968,182 | 11/1990 | Westwell | 405/221 |
| 5,152,108 | 10/1992 | Madl, Jr. . | |
| 5,217,325 | 6/1993 | Freeman, III . | |
| 5,515,655 | 5/1996 | Hoffmann . | |
| 5,564,235 | 10/1996 | Butler . | |
| 5,680,731 | 10/1997 | Guy . | |
| 5,848,507 | 12/1998 | Bozich | 52/126.5 |

FOREIGN PATENT DOCUMENTS

| | | | |
|---|---|---|---|
| 470652 | 1/1951 | Canada | 52/169.9 |

*Primary Examiner*—Michael Safavi
*Attorney, Agent, or Firm*—Jones & Askew LLP

[57] ABSTRACT

An adjustable pier assembly for use with a railroad control house includes a frame member, a movable sleeve having a pair of flanges rigidly attached to an extending sidewardly therefrom, and a pair of fine adjustment threaded members having associated hardware. By adjusting an initial adjustment bolt, an initial "rough" height adjustment is provided between the pier and the sleeve. A final fine adjustment is then provided between the sleeve and the frame of the apparatus by adjusting the location of the fine adjustment nuts which combine to capture the flanges along the lengths of their respective fine adjustment bolts. When four adjustment pier assemblies are used on four corresponding corners of a railway control equipment house, quick initial setup followed by fine leveling adjustment in two axes is readily provided.

14 Claims, 4 Drawing Sheets

ADJUSTABLE PIER RAILROAD HOUSE ASSEMBLY HAVING DUAL ADJUSTMENT CAPABILITIES

CROSS REFERENCE TO RELATED APPLICATION

This application claims the benefit of U.S. Provisional Application Serial No. 60/070,631 filed Jan. 7, 1998.

TECHNICAL FIELD

This invention relates in general to railroad equipment, and particularly relates to an adjustable pier having multiple adjustment capabilities for use in supporting a railroad control equipment house and a method of using same.

BACKGROUND OF THE INVENTION

Various adjustable support members are known in the prior art. For example, an adjustable support member is known which includes a pair of telescoping members, at one end of which is supported a threaded member threadably engaging a internally threaded "donut"-type end member. The end member fits into the end of one of the telescoping members. The telescoping members can be roughly adjusted for height, and then threaded engagement can be operated to allow for fine adjustment. Such a structure is typically used in providing "jack posts", for providing structural supports for house foundations, etc.

Although the prior art includes advantages, it nevertheless includes disadvantages. For example, the known prior art does not provide an easy initial adjustment feature followed by fine adjustment features which discourage binding.

Furthermore, there is a need in the art for the provision of railroad equipment control houses, which are typically placed along railroad right of ways which by their nature in many instances do not provide access for concrete trucks to pour foundations. One solution has been to provide precast concrete foundation sections which are bolted together at the site. Another prior art concept includes the use of steel foundations. Installation of either of these foundations can prove time consuming and dangerous. Furthermore, after the required excavation has settled, the house is typically out of level. Releveling of prior art structures can prove difficult considering the weight of the buildings.

Therefore, there is a need in the art to provide an adjustable railroad house pier having multiple adjustment capabilities which discourages binding, allows for quick and easy installation of a railroad control equipment house, allows for post-installation adjustment after settling, and provides safety features.

SUMMARY OF THE INVENTION

The present invention provides an improvement over the prior art by providing a more efficient and safe method and apparatus for "setting" such equipment houses, by the use of an adjustable railroad house pier having multiple adjustment capabilities which discourages binding, allows for quick and easy installation of a railroad control equipment house, allows for post-installation adjustment after settling, and provides safety features.

Therefore it is an object of the present invention to provide an improved house pier system.

It is a further object of the present invention to provide a house pier system which includes an improved adjustment feature.

It is a further object of the present invention to provide a house pier system which is easy to use.

It is a further object of the present invention to provide a house pier system which is easy to manufacture.

It is a further object of the present invention to provide a house pier system which is an improvement over the prior art.

It is a further object of the present invention to provide a house pier system which can be operated by personnel without a particularly high technical expertise.

It is a further object of the present invention to provide an adjustment mechanism which includes a minimum of moving parts.

It is a further object of the present invention to provide an adjustment mechanism which does not tend to bind.

It is a further object of the present invention to provide an adjustment mechanism which provides infinite adjustment features.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
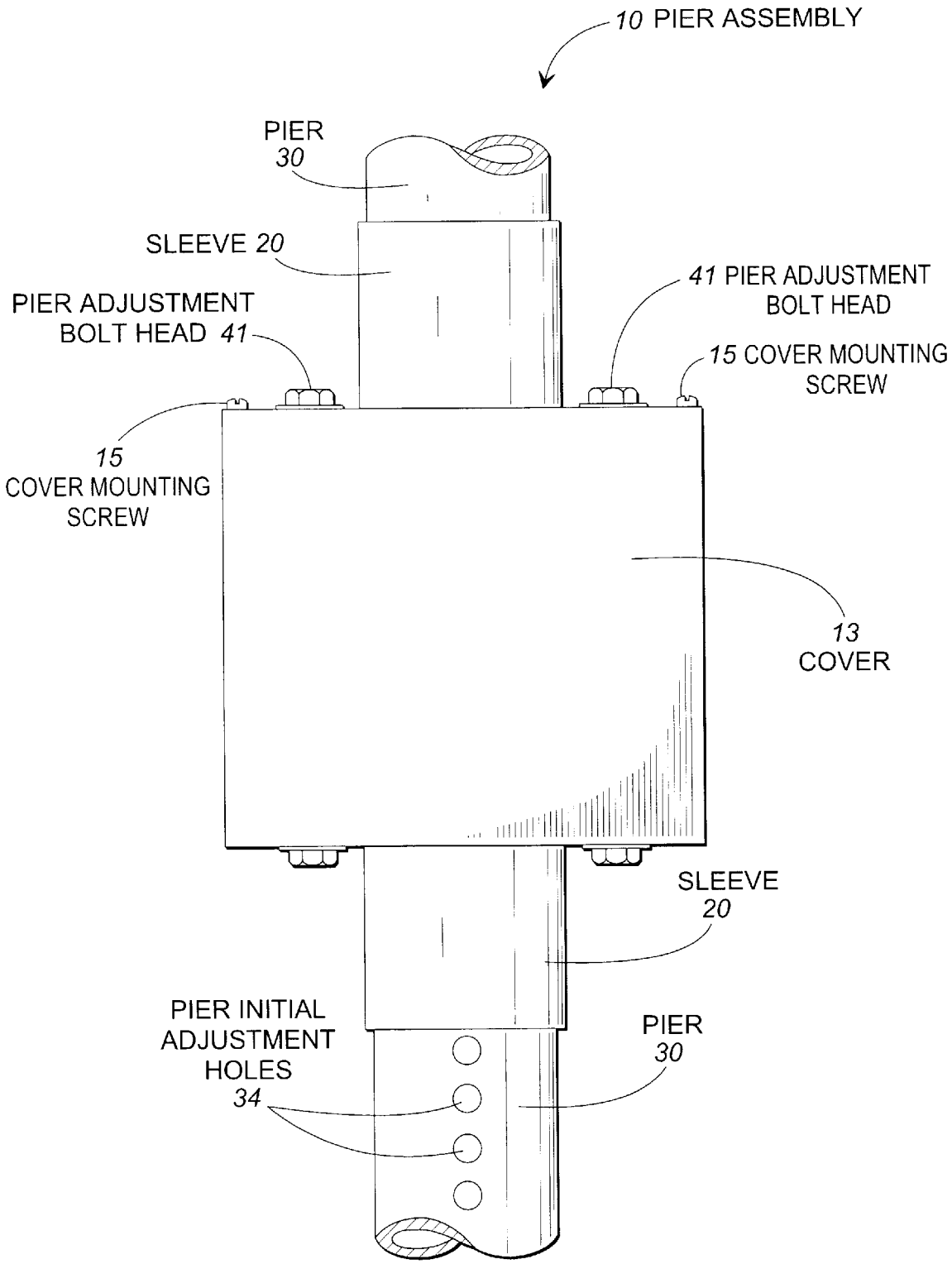
FIG. 1 is a front elevational view of an adjustable pier assembly 10 according to the present invention, including a cover 13.

Reference is now made to FIGS. 1–5, in which like numerals designate like items throughout the several views.

General Construction and Operation

The adjustable pier assembly 10 according to the present invention includes a frame member 12, a movable sleeve 20 having a pair of flanges 24 rigidly attached to an extending sidewardly therefrom, and a pair of fine adjustment threaded members 40 having associated hardware. By adjusting an initial adjustment bolt 36, an initial "rough" height adjustment is provided between the pier 30 and the sleeve 20. A final fine adjustment is then provided between the sleeve 20 and the frame 12 of the apparatus 10 by adjusting the location of the fine adjustment nuts 44 which combine to capture the flanges 24 along the lengths of their respective fine adjustment bolts 40. When four adjustment pier assemblies 10 are used on four corresponding corners of a railway control equipment house such as 100, quick initial setup followed by fine leveling adjustment in two axis is readily provided.

Details of Construction

Reference is now particularly made to FIG. 1, which is a front elevational view of an adjustable pier assembly 10 according to the present invention. In FIG. 1, a cover 13 is shown covering adjustable elements discussed in detail below. The cover 13 is mounted in place by a plurality of cover mounting screws 15, although other mounting means may be provided without departing from the spirit and scope of the present invention.

Figure 2:
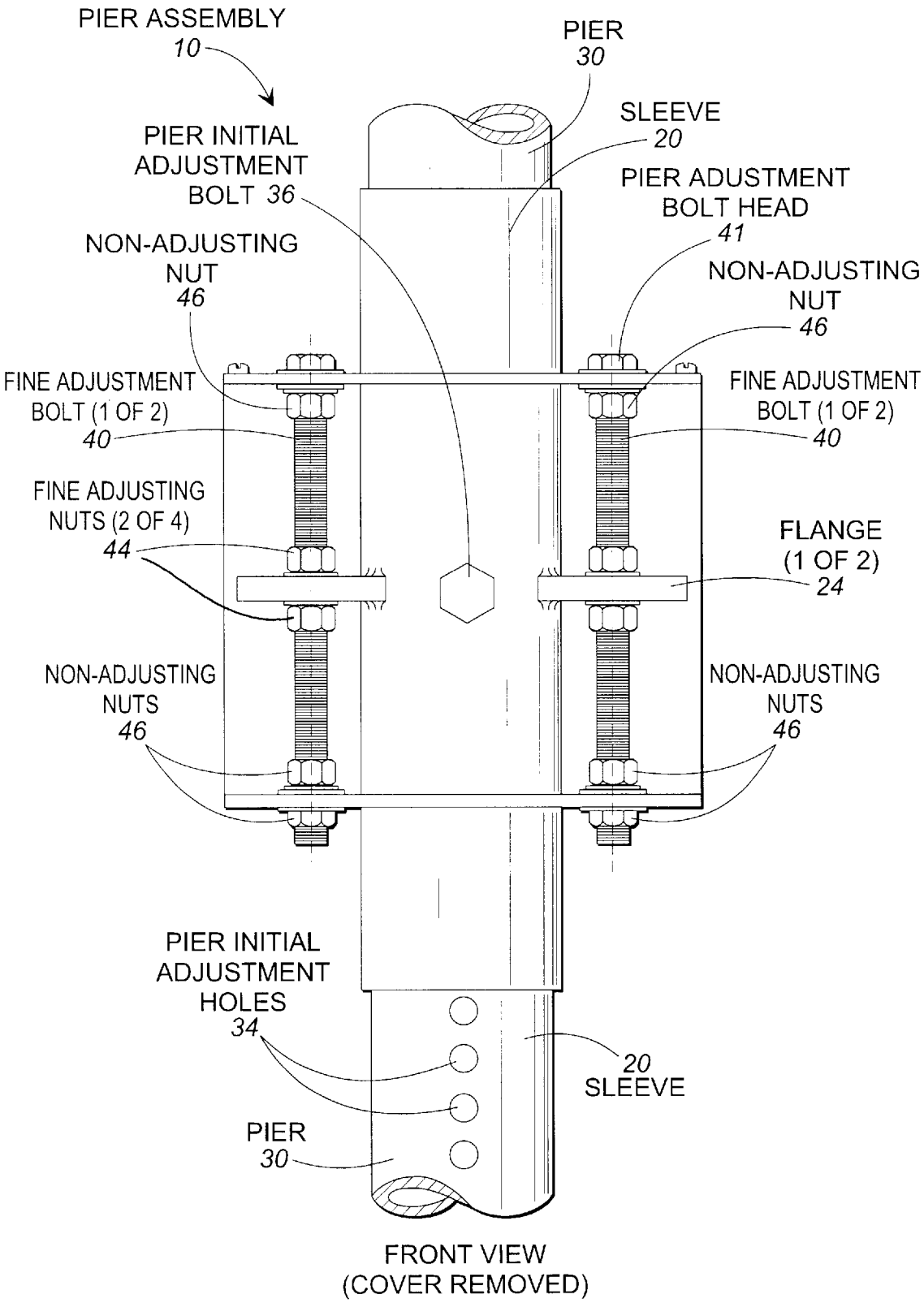
FIG. 2 is a view similar to that shown in FIG. 1, except the cover 13 has been removed.
Figure 3:
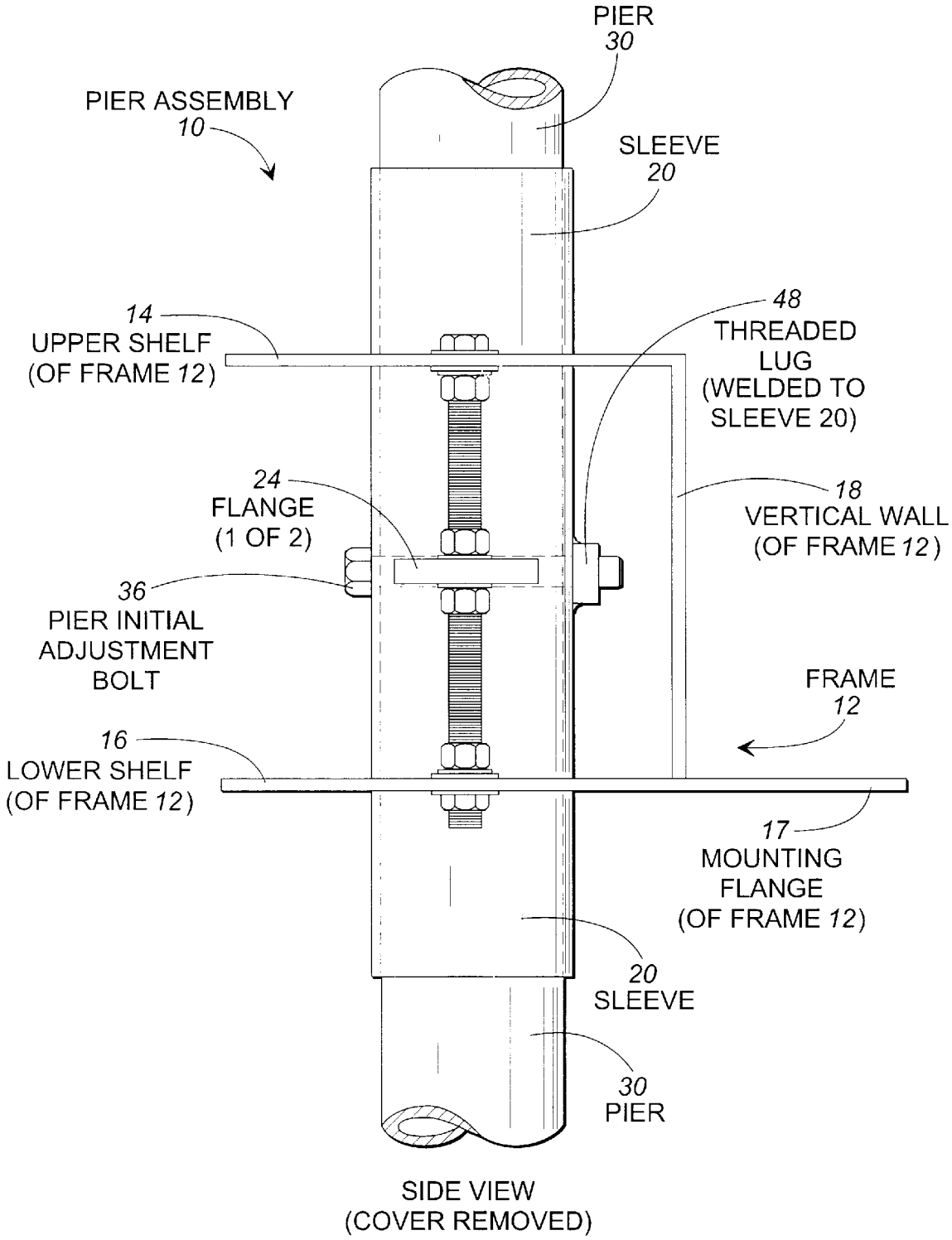
FIG. 3 is a side elevational view of that shown in FIGS. 1 and 2.

Reference is now also made to FIGS. 2 and 3. FIG. 2 is a front elevational view of an adjustable pier assembly 10 according to the present invention with the cover removed. FIG. 3 is a right side elevational view of that shown in FIG. 2.

As shown by FIG. 3, the apparatus includes a frame 12, which itself includes an upper shelf 14, a lower shelf 16, a vertical wall 18, and a mounting flange 17. The mounting flange 17 and the lower shelf 16, and in the preferred embodiment shown, are formed out of single piece of metal. The upper shelf, and vertical wall are, in the preferred embodiment, made of separate plates of metal, although other configurations may be provided without departing from the spirit and scope of the present invention.

When in their typical installed orientations, the upper and lower shelves 14, 16, of the frame 12 are substantially horizontal and coplanar. Each of the upper and lower shelves, 14, 16, includes one major hole, and two minor holes extending therethrough. The major holes are substantially coaligned, and slidably accept an elongate hollow sleeve 20 as discussed elsewhere. The minor holes are likewise substantially aligned to allow acceptance of the fine adjustment bolts 40 such as shown in FIG. 2.

The mounting flange 17 of the frame 12 is attached to the underside of a building 100 as discussed elsewhere.

The sleeve 20 is tubular and elongate and includes an elongate bore for accepting a length of the pier 30 as discussed elsewhere in this application. Two opposing flanges 24 extend sidewardly from the outside surface of a middle part of the sleeve 20. The opposing flanges 24 are substantially planar, in one preferred embodiment being composed of flat plate stock having one edge welded to the outside surface of the sleeve 20. As discussed elsewhere, this flat plate stock is captured between two corresponding fine adjustment nuts 44 and facilitate fine adjustment of the pier assembly 10.

The pier 30 is substantially elongate and tubular. The pier 30 is tubular although a solid configuration is contemplated without departing from the spirit and scope of the present invention. The pier includes a plurality of initial adjustment holes 34 extending transversely to the longitudinal axis of the elongate pier 30. These holes 34 accept the transverse cross section of an initial adjustment bolt 36, when it extends through the holes 34 and also the single hole in the sleeve 20, as shown in FIG. 3.

Bolt 36 screws into a threaded aluminum lug welded to the back of sleeve 20.

A pier foot is attached to the lower end of the pier for contact with a supporting surface such as the ground.

The fine adjustment bolts 40, and their associated hardware, are similar in operation; therefore, one will be discussed as an example of the other. The fine adjustment bolts 40 have a head 41, and a threaded body. The threaded body is substantially elongate, and extends through two holes, one hole in the upper shelf 14, and another hole in the lower shelf 16. Associated hardware mounts the fine adjustment bolt relative to the frame 12. Fine adjustment nuts 44 "snug" up next to each flat surface of the flange 24. By adjusting the fine adjustment nuts 44, the flange 24 may be raised or lowered as desired. As the flange 24 is rigidly attached to the sleeve 20, this likewise provides an adjustment feature between the frame 12 and the sleeve 20. As the sleeve 20 is attached to the pier 30 by the initial adjustment bolt 36, this likewise provides an overall adjustment feature for the adjustable pier assembly 10.

Installation and Adjustment

Figure 4:
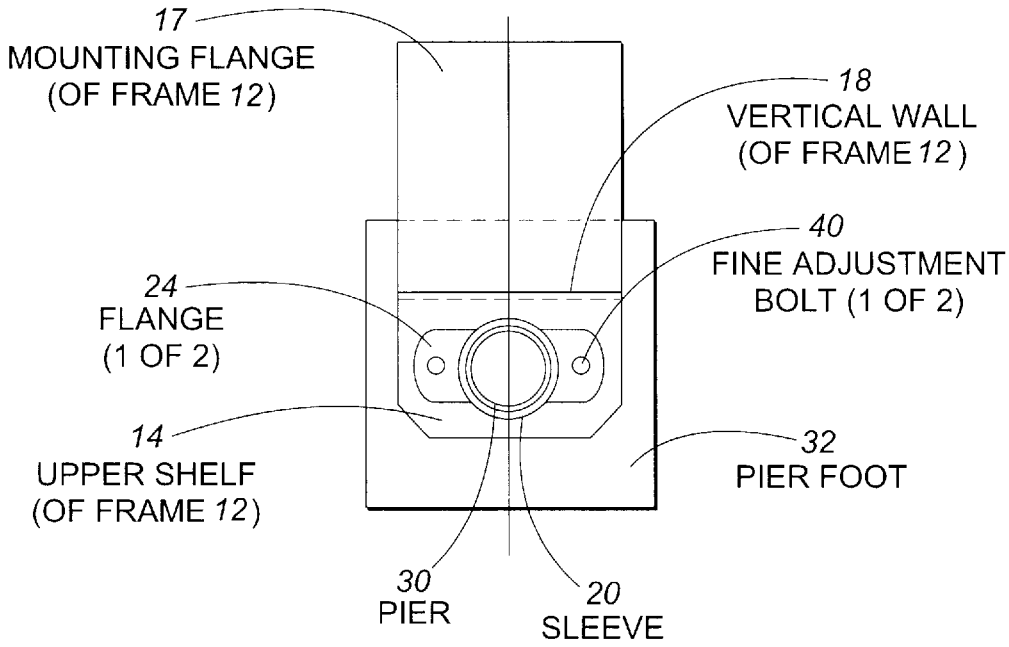
FIG. 4 is a top elevational view of that shown in FIGS. 2 and 3, with the pier 30 shown in cross section.
Figure 5:
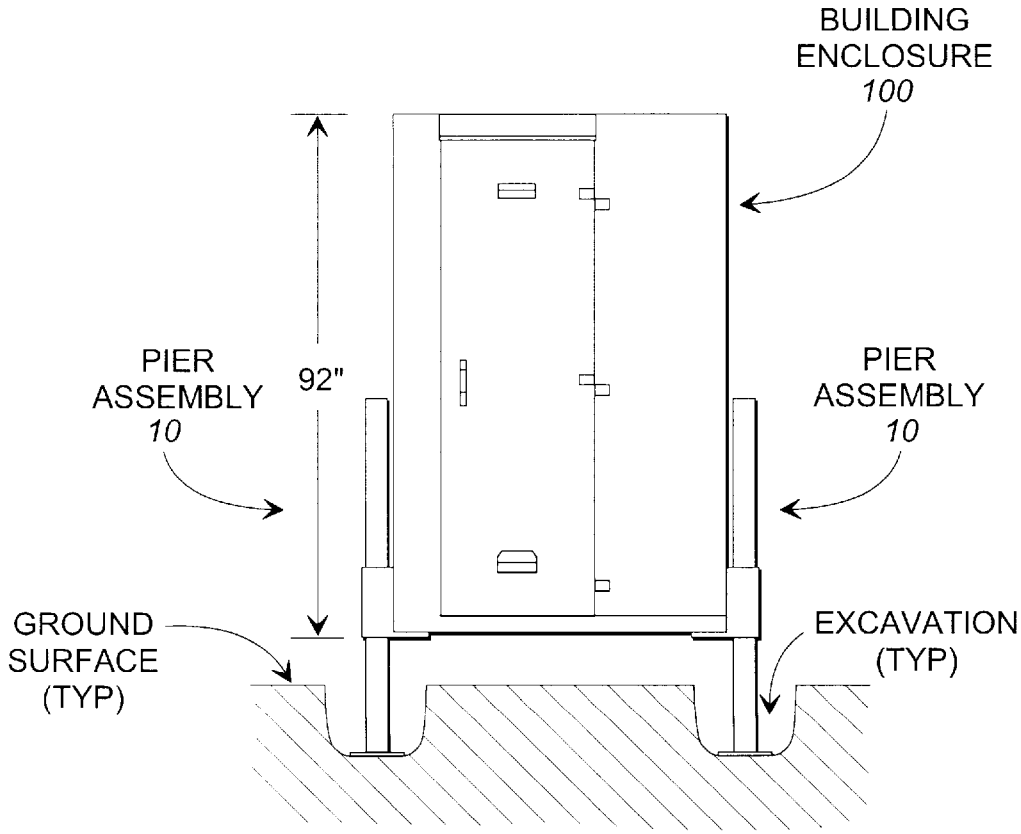
FIG. 5 is a front elevational view of a railroad equipment house 100 including a plurality of adjustable pier assemblies 10 according to the present invention. Two adjustable pier assemblies 10 are shown, although in the preferred embodiment, four are used, one on each corner of the substantially rectangular enclosure 100. The piers are shown with their feet atop supporting surfaces which are below ground level. Backfill has not yet been added.

Reference is now also made to FIGS. 4 and 5.

FIG. 5 shows a house or building 100 equipped with four externally mounted adjustable pier assemblies 10 although only two are viewable. This allows installation and precise leveling of the house without the necessity of entering the enclosure until the house is secured in place.

Installation of the apparatus can take many forms, but one method includes the use of a crane (not shown) for lifting the house with the piers at a preset length. After four holes or two long parallel trenches are dug, the crane suspends the house over the excavated site at a initial height relative to the ground.

For installation and adjustment, the protective covers 13 should be removed from the remainder of the apparatus. This is accomplished by removing the two cover mounting screws 15 from the top lip of the cover 13 (see FIG. 1).

While the house is still suspended by the crane, the adjustable piers 30 are each lowered into place by removing their corresponding pier initial adjustment bolt 36 (see FIG. 2), allowing the pier to drop until its foot contacts the excavated surface. The initial adjustment bolt 36 is then replaced through one of the initial adjustment holes in the pier itself, allowing for leveling in 1" increments. The initial adjustment bolt 36 is then securely tightened in place. At this point the house can be released by the crane, and backfill can be placed stop the feet such that the feet are buried as desired, at a depth typically around 3–4 feet.

Exact leveling is accomplished through the fine adjusting nuts 44 on the sides of the adjustment mechanism. The house can be adjusted approximately +/−3" from its center position by raising or lowering the fine adjusting leveling nuts 44 on the fine adjustments bolts 40. This allows for an infinite number of settings to insure accurate leveling of the house. Note that the fine adjustment bolts 40 themselves do not need to be rotated.

After leveling, the cover 13 should be replaced over the adjustment mechanism. Cast aluminum top caps (not shown) are shipped in the house to be placed on the ends of the adjustable piers.

Alternative Designs

In the preferred embodiment, the flanges 24 extend sidewardly, and generally oppositely, from the sleeve 20. In the preferred embodiment, each of the flanges are welded to the sleeve 20, although other configurations, such as a single cast configuration are contemplated without departing from the spirit and scope of the present invention.

Other alternative designs may be provided without departing from the spirit and scope of the present invention.

Materials

The materials used to provide the various elements of the invention include but are not limited to aluminum with a hot dip galvanized steel pier and hot dip galvanized steel hardware.

Advantages

The present invention provides many advantages over the prior art, in the areas of installation, post-installation adjustment, and general safety.

With respect to installation, the fine tune adjustable pier allows for quicker and easier installation of a railroad control equipment house. The design of the piers does not require house excavation to be completely level on all points of foundation excavation.

With respect to adjustment, the fine tune adjustable pier allows for adjustment both at the time of installation and after a period of settling. The house can be leveled at any point at any time without the use of heavy lifting or excavating equipment.

With respect to safety, the fine tune adjustable pier is designed to reduce safety hazards both during and after installation. When the house is being set, it is not necessary to enter the excavations for the piers. Unlike some prior art designs, there is also limited exposure underneath suspended objects. Complete installation can be made to secure the equipment house without the need to enter the house before it is in place.

Conclusion

Therefore it may be seen that the present invention provides many improvements over the art. The piers according to the invention are an integral part of the house and no assembly is required. There is no need for workers to be in the excavation when setting the house, as the pier feet are dropped in from above. The house and pier combination allows for the hose to be leveled at any time without the use of a crew or heavy equipment. Finally, the house/pier combination is cost effective compared to other methods.

While this invention has been described in specific detail with reference to the disclosed embodiments, it will be understood that many variations and modifications may be effected within the spirit and scope of the invention as described in the appended claims.

What is claimed is:

1. An adjustable pier assembly for use with a railroad control house situated atop a supporting surface, said railroad control house having a frame, said adjustable pier assembly configured to support at least part of the weight of said railroad control house above said supporting surface, said adjustable pier assembly comprising:

a pier member for contact with said supporting surface, such that said pier member is at least partially supported by said supporting surface;

a sleeve member;

an initial height adjuster intermediate said pier member and said sleeve member for providing adjustable support of said sleeve member by said pier member;

a pier frame configured to be rigidly attached relative to said frame of said railroad control house; and a secondary height adjuster intermediate said pier frame and said sleeve, said secondary height adjuster configured to provide adjustable support of at least a portion of the weight of said railroad control house, said secondary height adjuster itself comprising:

a) an elongate threaded screw member attached to one of said sleeve member and said pier frame;

b) a flange member extending from the other one of said sleeve member and said pier frame, said flange member including a through hole configured to accept the cross section of said threaded screw member; and c) a pair of threaded nuts threadably attached along the length of said elongate threaded screw member, said pair of threaded nuts configured to capture said flange member such that movement of said flange member in either direction along the length of said screw member is restricted.

2. The adjustable pier assembly as claimed in claim 1, further comprising said flange attached to and extending sidewardly relative to said sleeve, wherein said secondary height adjuster is intermediate said flange and said frame.

3. The adjustable pier assembly as claimed in claim 1, further comprising a second sidewardly-extending flange and also further comprising a second secondary height adjuster intermediate said second flange and said frame.

4. The adjustable pier assembly as claimed in claim 1, wherein said frame further comprises an upper and a lower planar shelf each defining a guide hole through which said sleeve extends.

5. The adjustable pier assembly as claimed in claim 4, wherein said initial height adjuster is an elongate member extending through a hole in said sleeve and likewise extending through one of a plurality of holes in said pier, such that installation and removal of said elongate initial adjustment member allows for variable positions of said pier to be provided relative to said sleeve.

6. The adjustable pier assembly as claimed in claim 5, wherein said second adjuster is provided by a threaded member attached to said frame and having a portion threadably engaged relative to said flange.

7. An adjustable pier railroad control house assembly for use atop a supporting surface, said assembly comprising:

a railroad control house enclosure including a frame;

at least one pier member for contact with said supporting surface;

a sleeve member;

an initial height adjuster intermediate said pier member and said sleeve member for providing adjustable support of said sleeve member by said pier member;

a pier frame attached to the railroad control house and configured to be rigidly attached relative to said frame of said railroad control house; and secondary adjustment means for providing adjustment intermediate said pier frame and said sleeve such that said height of at least a portion of said railroad control house enclosure can adjusted, said secondary height adjuster configured to provide adjustable support of at least a portion of the weight of said railroad control house, said secondary height adjuster itself comprising:

a) an elongate threaded screw member attached to one of said sleeve member and said pier frame;

b) a flange member extending from the other one of said sleeve member and said pier frame, said flange member including a through hole configured to accept the cross section of said threaded screw member; and c) a pair of threaded nuts threadably attached along the length of said elongate threaded screw member, said pair of threaded nuts configured to capture said flange member such that movement of said flange member in either direction along the length of said screw member is restricted.

8. The adjustable pier railroad control house as claimed in claim 7, further comprising said flange attached to and extending sidewardly relative to said sleeve, wherein said secondary height adjuster is intermediate said flange and said frame.

9. The adjustable pier railroad control house assembly as claimed in claim 7, further comprising a second sidewardly-extending flange and also further comprising a second secondary height adjuster intermediate said second flange and said frame.

10. The adjustable pier railroad control house assembly as claimed in claim 7, wherein said frame further comprises an upper and a lower planar shelf each defining a guide hole through which said sleeve extends.

11. The adjustable pier railroad control house assembly as claimed in claim 7, wherein said initial height adjuster means is provided by an elongate member extending through a hole in said sleeve and likewise extending through one of a plurality of holes in said pier, such that installation and removal of said elongate initial adjustment member allows for variable positions of said pier to be provided relative to said sleeve.

12. The adjustable pier railroad control house assembly as claimed in claim 13, wherein said second adjuster is provided by a threaded member attached to said frame and having a portion threadably engaged relative to said flange.

13. A method of installing a railroad control house assembly, said method comprising:

A) providing the following assembly:
- a railroad control house enclosure;
- at least one pier member;
- a sleeve member;
- an initial height adjuster intermediate said pier member and said sleeve member;
- a pier frame attached to the railroad control house; and
- a secondary adjuster for providing adjustment intermediate said pier frame and said sleeve, B) suspending said assembly provided in step "A" over a supporting surface;

C) disengaging said initial height adjuster intermediate said pier member and said sleeve member so that said pier member contacts said supporting surface;

D) reengaging said initial height adjuster intermediate said pier member and said sleeve member;

E) releasing said assembly from said suspension in step "B"; and

F) manipulating said secondary adjuster to provide adjustment intermediate said pier frame and said sleeve so that said height of at least a portion of said railroad control house enclosure is adjusted.

14. The method of installing a railroad control house assembly as claimed in claim 13, further comprising the step of digging a hole in the ground to provide said supporting surface below ground surface prior to step "C", and also further comprising the step of filling said hole after step "E".

* * * * *